US006079528A

United States Patent [19]

Moor

[11] Patent Number: 6,079,528

[45] Date of Patent: Jun. 27, 2000

[54] BINDER WITH OUTWARDLY BIASED GUSSET

[75] Inventor: Marc Moor, Oakwood, Ohio

[73] Assignee: The Mead Corporation, Dayton, Ohio

[21] Appl. No.: 09/073,749

[22] Filed: May 6, 1998

[51] Int. Cl.[7] ..... A45C 3/02; A45C 13/10

[52] U.S. Cl. ..... 190/126; 190/900; 190/901; 190/903; 150/128; 383/97

[58] Field of Search ..... 190/126, 901, 190/903, 900, 107; 383/97; 150/128

[56] References Cited

U.S. PATENT DOCUMENTS

| | | | |
|---|---|---|---|
| 1,983,036 | 12/1934 | Kaufmann | 190/901 X |
| 2,011,879 | 8/1935 | Stein | 190/901 X |
| 2,067,851 | 1/1937 | Lifton | 190/901 X |
| 2,173,120 | 9/1939 | Lifton | 150/1.6 |
| 2,252,783 | 8/1941 | Potts et al. | 129/1 |
| 2,298,786 | 10/1942 | Dubofsky et al. | 190/126 |
| 2,475,277 | 7/1949 | Budnik | 150/128 X |
| 2,502,275 | 3/1950 | Perlin | 150/1.6 |
| 2,556,066 | 6/1951 | Cline | 190/903 X |
| 2,581,763 | 1/1952 | Hickler | 190/901 X |
| 2,755,837 | 7/1956 | Kosek | 150/1.6 |
| 2,778,397 | 1/1957 | Carrasco | 150/1.6 |
| 3,280,871 | 10/1966 | Taylor | 150/52 |
| 3,613,843 | 10/1971 | Davis | 190/126 X |
| 4,303,602 | 12/1981 | Lichter et al. | 264/45.4 |
| 4,610,923 | 9/1986 | Schrock | 428/304.4 |
| 4,629,349 | 12/1986 | Pitts | 402/74 |
| 4,629,651 | 12/1986 | Davis | 386/113 |
| 4,775,257 | 10/1988 | Rigg | 402/9 |
| 4,784,248 | 11/1988 | Workman | 190/126 |
| 4,913,074 | 4/1990 | Saliba | 190/903 X |
| 4,961,596 | 10/1990 | Moor | 281/15 |
| 5,080,206 | 1/1992 | Tawil | 190/103 |
| 5,105,338 | 4/1992 | Held | 190/903 X |
| 5,153,939 | 10/1992 | Howe et al. | 2/69 |
| 5,161,731 | 11/1992 | Rivlin et al. | 229/67.3 |
| 5,219,437 | 6/1993 | Moor et al. | 281/29 |
| 5,236,226 | 8/1993 | Sheffield | 281/48 |
| 5,611,573 | 3/1997 | Lobel et al. | 281/29 |
| 5,711,750 | 1/1998 | Christensen et al. | 493/210 |

FOREIGN PATENT DOCUMENTS

| | | | |
|---|---|---|---|
| 5269016 | 10/1993 | Japan | 190/900 |
| 571891 | 9/1943 | United Kingdom | 190/126 |

*Primary Examiner*—Sue A. Weaver
*Attorney, Agent, or Firm*—Thompson Hine & Flory LLP

[57] ABSTRACT

The invention is a binder or portfolio for carrying looseleaf paper, books, school supplies, etc. wherein the binder includes a split gusset that is attached to the front and back covers of the binder. The gusset is secured into the binder in a manner such that it is biased outwardly of the binder when the binder is opened, thereby facilitating insertion or removal of items from the binder.

15 Claims, 3 Drawing Sheets

BINDER WITH OUTWARDLY BIASED GUSSET

BACKGROUND OF THE INVENTION

This invention relates to a portfolio or binder for holding papers, books, school supplies, etc., which includes a gusset which is attached to the binder so that the gusset is biased outwardly of the folder. The gusset of the invention may be made of any number of suitable materials including vinyl, leather, textiles such as woven polyester or nylon, or even expandable, elastic materials such as neoprene. More particularly, the present invention relates to a binder wherein a gusset is incorporated between the front and back covers of the binder, the gusset has a front portion and a back portion corresponding to the front and back covers of the binder and the gusset is attached to the covers so that a substantial portion of the gusset is biased outwardly of the interior of the binder. Preferably, the gusset includes a closure means which releasably fastens the two portions of the gusset together, thereby enclosing the contents of the binder.

In the past there have been binders and portfolios having zippered closures for retaining loose items in the binder. An example of this type of binder is disclosed in U.S. Pat. No. 2,778,397 which illustrates a cover for a loose leaf notebook or the like. The cover is composed of a unitary piece of leather and is closed by means of a zipper. U.S. Pat. No. 2,755,837 discloses a brief case for holding personal papers having a back portion with a pair of side panels that are connected by a slide fastener. Yet another example is shown in U.S. Pat. No. 2,173,120 which discloses a brief case having front and rear flexible panels, preferably made of leather, that are spaced apart by a split flexible gusset having a zipper mechanism for closing the gusset. A strengthening member is employed to help the flexible components and gusset to retain their desired shape.

While many of these prior art binders have advantages, there continues to be a need to design binders having split gussets for enclosing the contents of the binders which are flexible, durable, sturdy, and inexpensive to manufacture. Accordingly, it would be desirable to have a split gusset which is attached to a binder in such a way that the gusset is biased outwardly of the folder so that access to the contents of the binder is facilitated when the binder is laid open. Furthermore, it is desired to have a binder including a gusset biased outwardly of the binder so that a releasable closure attached to the gusset can be easily detached and reattached without interference from the contents of the binder. It is further desired to have a binder including an outwardly biased gusset that can be smaller than a standard binder for holding the same size paper since the outwardly biased gusset occupies minimal space within the binder.

SUMMARY OF THE INVENTION

In accordance with the present invention, a binder or portfolio is provided which is has a split gusset with a releasable closure wherein the gusset is attached to the binder in a manner so that the gusset is biased outwardly of the binder. More particularly, the invention provides a binder or portfolio comprising a front and back cover foldably joined to a central spine having a split gusset substantially formed from a flexible material. The gusset has a front portion attached to the periphery of the underside of the front cover, and a back portion attached to the periphery of the underside of the back cover, wherein the two portions of the gusset may be releasably fastened to one another when the front cover is folded over on the back cover.

The binder of the present invention is equipped with a ring type closure for securing loose leaf papers. However, in the portfolio, the ring closure is omitted so that the covers enclose a generally open area for the carrying of loose objects and papers. While the discussion which follows references the embodiment of the invention which is a binder, those skilled in the art will recognize that the discussion applies equally to portfolios. In a preferred embodiment, the covers of the binder include a flat cushioning member made of a suitable material, such as high density pearlized foam, attached to a rigid polyethylene board which is covered in a durable fabric, such as nylon. The front and back portions of the gusset are incorporated into the binder in a way so as to allow the gusset to be biased outwardly of the binder when it is fully opened thereby providing unfettered access to the contents and allowing papers and other items to be placed flatly within the binder with minimal interference from the gusset. One advantage of using an outwardly biased gusset is that the overall size of the binder can be reduced because less clearance is required between the edges of the enclosed papers and the gusset. While it is contemplated that many different closure means may be used to secure the front and back portions of the gusset together when the binder or portfolio is folded to a closed position, in a preferred embodiment a zipper type closure is employed. This zipper closure can be one of any number of different configurations, including closed-end type, open-end type, or a combination of the two.

DETAILED DESCRIPTION

Figure 1:
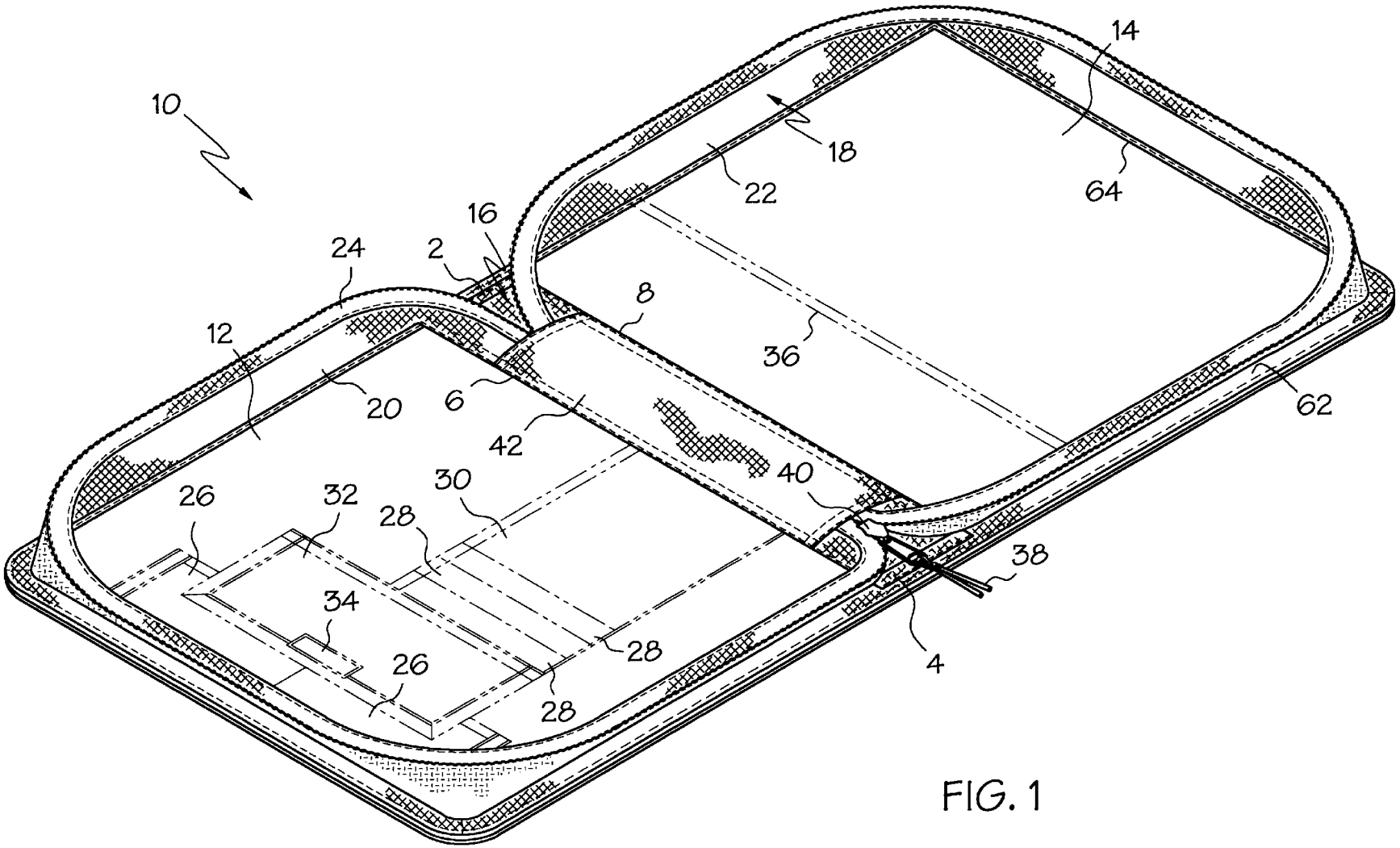
FIG. 1 is a top perspective view of a binder or portfolio with an outwardly biased gusset in accordance,with the present invention.
Figure 2:
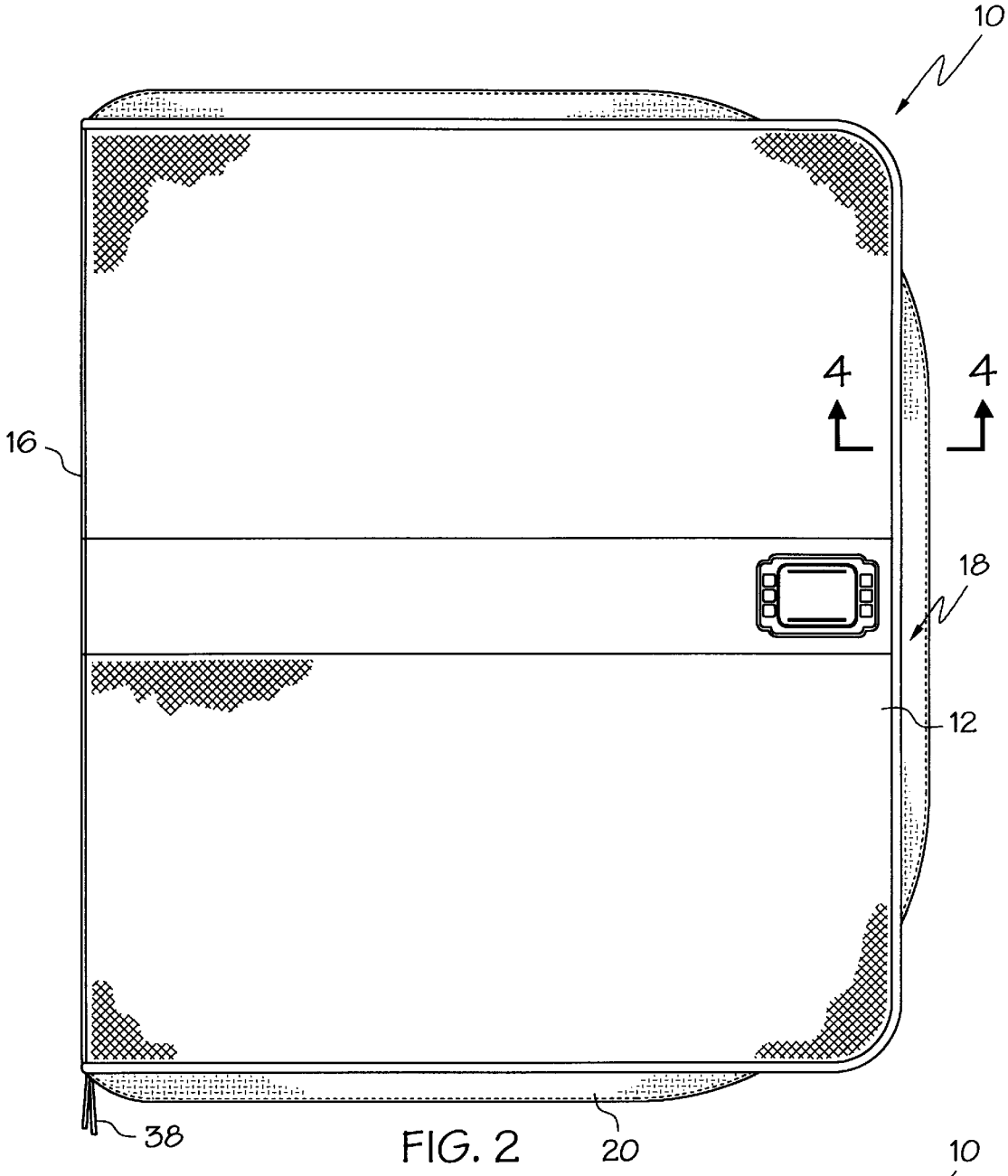
FIG. 2 is a plan view of the top of the closed binder of FIG. 1.
Figure 3:
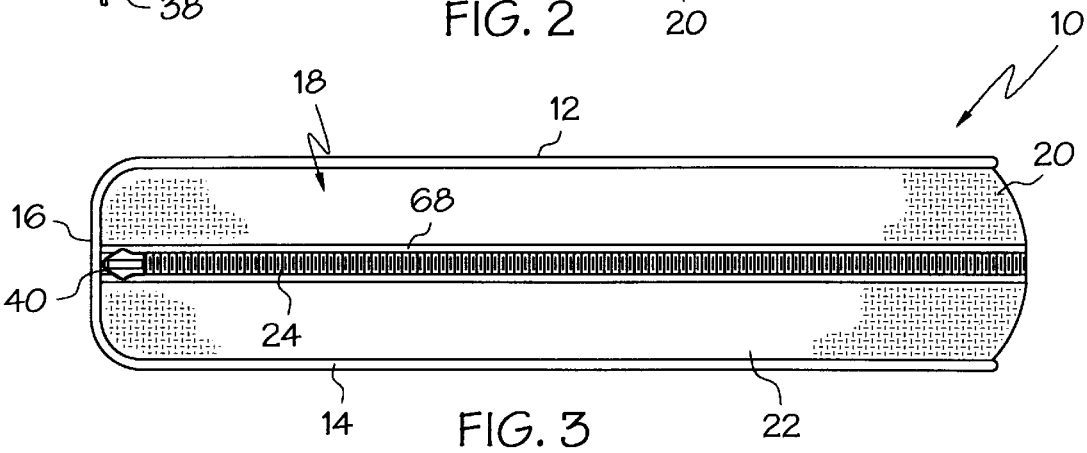
FIG. 3 is a side elevational view of the binder of FIG. 2.

Referring to FIGS. 1, 2 and 3, the binder or portfolio generally designated 10 of the present invention includes a front cover 12, back cover 14, a central spine 16 having a top 2, bottom 4, and two sides 6, 8, and a flexible gusset 18, preferably made of a woven polyester material such as 150 denier rip stop polyester. The front cover 12 and back cover 14 are spaced apart from each other by the central spine 16 and the flexible gusset 18. The flexible gusset 18, is divided into a front portion 20, corresponding to the front cover 12, and a back portion 22, corresponding to the back cover 14. The two portions of the gusset 18 share a zipper 24, which can be closed to secure the contents of the binder 10.

In a preferred embodiment, the binder 10 has various pockets sewn into the inside of the front cover 12. Illustrative of the variety of pockets that may be utilized, the embodiment as shown in FIG. 1 has computer disc pockets 26, pencil pockets 28, and a miscellaneous pocket 30. Computer discs (not shown) are held into the computer disc pockets 26 by a flap 32 that is secured by a hook and loop closure 34. A pocket 36 which runs the width of the back cover 14 of the binder 10 of the present invention is provided to allow for insertion of a tongue for a ring closure (not shown). Alternatively, the ring closure can be secured to the spine using rivets or other fasteners known in the art. While the number and function of the pockets herein described are those of a preferred embodiment, it would be clear to one of ordinary skill that any number of combinations, including elimination of the pockets altogether, may be utilized without departing from the scope of the invention.

As mentioned above, the gusset 18 of the binder 10 includes zipper 24 for securing any loose items within the binder 10. When the front cover 12 and back cover 14 are folded over onto each other, i.e. closed, the binder 10 can be secured by the zipper 24, which operates in a conventional manner. Thus, the binder is secured by grasping the pull tab 38 of the sliding member 40 and moving the sliding member 40 along the outer periphery of the covers until the sliding member 40 abuts a flexible expansion panel 42 fixedly attached to the spine 16 and the covers 12, 14 to prevent the covers from bending backward when the binder 10 is laid open. Thus, in this manner the binder is securely closed. While the embodiment depicted in FIG. 1 shows a binder having a zipper of the closed end-type, it should be clear that an open-end zipper, or a zipper having a straight run along one side of the binder or portfolio, as well as various other zipper arrangements, would be suitable. Furthermore, the use of non-zipper closure methods such as hook and loop, snaps, etc., or a so-called zip-lock slide closure would also be considered within the scope of the present invention.

Figure 4:
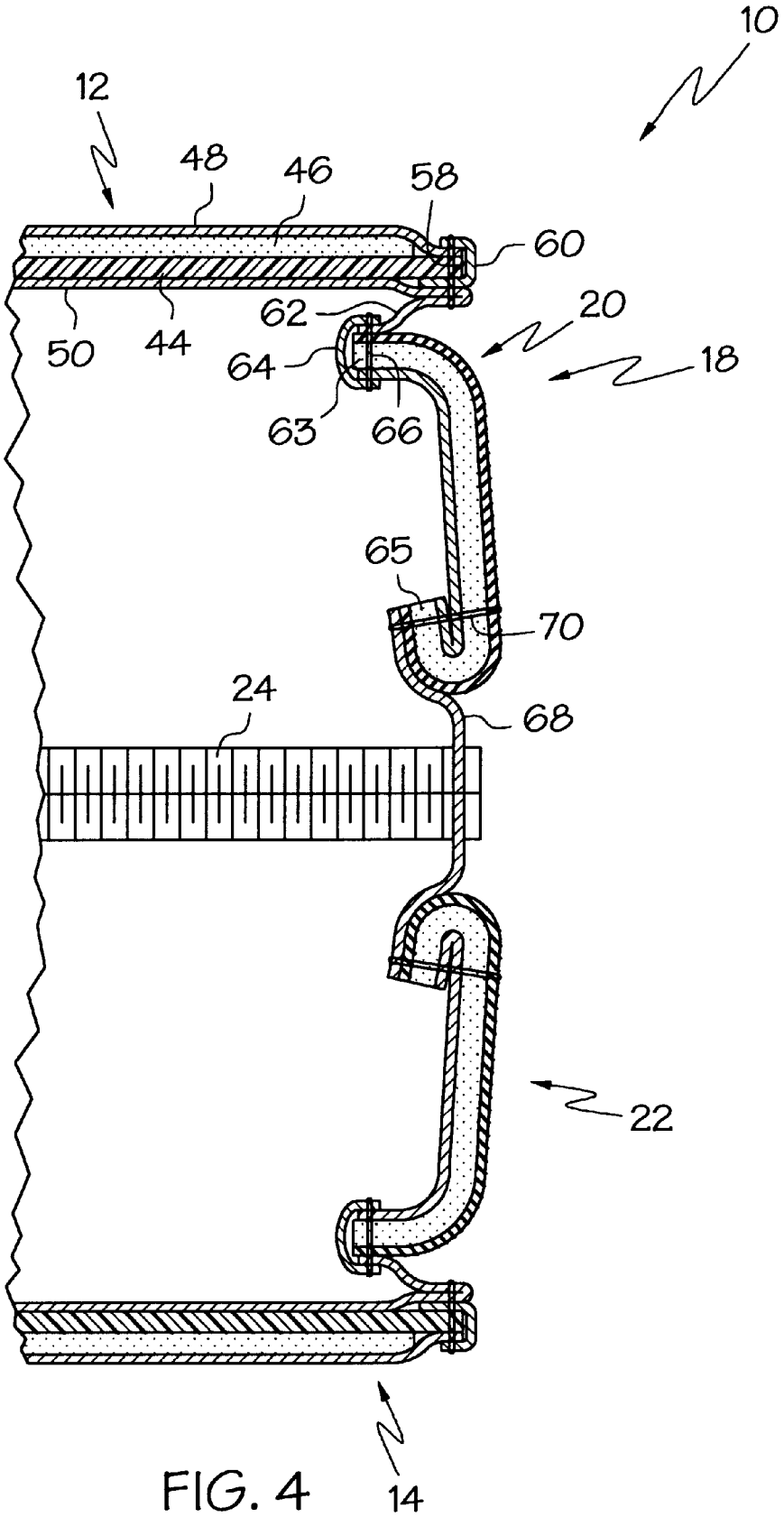
FIG. 4 is a schematic cutaway side elevational view of the binder of FIG. 2 taken at line 4—4.

As shown in FIG. 4 a preferred embodiment of the present invention has covers 12, 14 which are structurally defined by a rigid board 44, preferably made of polyethylene. Cushioning liner material 46 is carried on the rigid board 44 and both are then covered in a textile material 48. Although any suitable materials may be employed in these applications, it has been found that highly durable materials such as high density pearlized foam for the cushioning material and nylon or polyester fabrics for the textile covers are preferred. The use of the cushioning material 46 with the rigid board 44 and textile outer covering 48 provides surfaces which are padded, yet sturdy and durable. The underside of the covers 12, 14 are covered in a textile inner lining material 50, which may be the same material that is employed for the outside covering.

The construction of the front and back portions of the binder 10 of the present invention are substantially identical, and as such, for the sake of clarity, only the front portion will be referred to during the description that follows. In a preferred embodiment, as shown in FIG. 4, the inner lining material 50 extends to the edge of cover 12 where it is folded over upon itself and secured inside the outer periphery of the cover by outer cover seam 58. Outer cover seam 58 also simultaneously attaches a seam binding or edging material 60 along the outside edge of the binder to give the binder a smooth feel and a finished look while protecting the edge of the cover 12. The folded over inner liner material 50 extends into the interior of the binder to create an inwardly protruding attachment panel 62 for the front portion 20 of the elastic gusset 18. One side 63 of the front portion 20 of the elastic gusset 18 is folded or rolled inwardly so that it overlies the inwardly directed attachment panel 62 and this edge is covered in a seam binding 64 and stitched together by sewn seam 66. By inwardly rolling the gusset 18 and attaching it to the cover 12, the gusset 18 is biased outward of the binder 10 when it is laid open flat, as is shown in FIG. 1, and also when it is closed, as is shown in FIG. 2. However, those skilled in the art will recognize that other constructions can be used to attach the gusset 18 inside the covers so that the gusset is outwardly biased. The other side 65 of the upper portion 20 of gusset 18 is folded over on itself and attached to the zipper ribbon 68 by zipper ribbon seam 70, thereby securing the upper portion 20 of the gusset 18 to the zipper 24. While the seams are illustrated herein as being sewn, e.g., as shown by threads 66 and 70, other seaming techniques may be used including fusing, adhesives, etc.

As mentioned above, the outward biasing of the gusset 18, as opposed to the inward biasing generally seen in prior binders, is advantageous in many respects. For example, due to this biasing, there is generally unfettered access to the contents of the binder when it is laid open flat. Also, since the gusset occupies minimal space in the interior of the closed binder, it can be designed having a smaller footprint than prior binders for holding the same size paper. Another advantage is that the closures are easier to detach and reattach since the contents of the binder do not interfere with this procedure. Although the construction herein described is a preferred method for biasing the gusset 18 outwardly of the binder 10, those skilled in the art will appreciate that other methods would be effective and are considered within the scope of the scope of the invention.

While the form of the apparatus herein described constitutes a preferred embodiment of the invention, it is to be understood that the invention is not limited to this precise form of apparatus, and that changes may be made therein without departing from the scope of the invention.

What is claimed is:

1. A binder or portfolio comprising:

a front cover having an inner side and an outer side;

a back cover having an inner side and an outer side;

a central spine, said spine including top and bottom ends and two sides, wherein said front cover is foldably joined to one side of said spine and said back cover is foldably joined to the other side of said spine;

a flexible gusset having a front portion and a back portion, wherein the front portion of said gusset is attached to the periphery of said inner side of said front cover running from the top of said spine to the bottom of said spine, and the back portion of said gusset is attached to the periphery of said inner side of said back cover running from the top of said spine to the bottom of said spine, said front and back portions of said gusset being attached to said front and back covers so that said gusset is biased outwardly of said covers of said binder such that when said binder is laid open access to the contents of said binder is facilitated; and a closure means for releasably securing the front portion of said gusset to the back portion of said gusset.

2. The binder of claim 1 wherein said flexible gusset is formed from a textile material.

3. The binder of claim 2 wherein said textile material is a woven nylon.

4. The binder of claim 2 wherein said textile material is woven polyester.

5. The binder of claim 4 wherein said woven polyester is 150 denier rip stop polyester.

6. The binder of claim 1 wherein said closure means is composed of two interlocking tracks and a slide closure slidably attached to at least one of said tracks, wherein one of said tracks is fixedly attached to said gusset front portion and the other of said tracks is fixedly attached to said gusset back portion, such that when said binder front cover is folded to a position substantially in alignment with said binder back cover, said slide closure can be moved so as to interlock and integrally engage said tracks thereby closing said binder.

7. The binder of claim 1 wherein said closure means is a zipper.

8. The binder of claim 7 wherein both ends of said zipper are closed ended.

9. The binder of claim 1 wherein said front cover and said back cover are covered with a fabric material.

10. The binder of claim 1 wherein said front and back covers inner sides include an inwardly directed attachment panel for attaching said front and back portions of said gusset, said gusset being inwardly rolled and attached to said panel thereby biasing said gusset outwardly of said binder.

11. The binder of claim 10 wherein said attachment panel is fabric.

12. The binder of claim 11 wherein said fabric material is nylon.

13. A binder or portfolio comprising:

a front cover having an inner side and an outer side including a cushioning material carried on a rigid board covered in a fabric material;

a back cover having an inner side and an outer side including a cushioning material carried on a rigid board covered in a fabric material;

a central spine disposed between and foldably attached to said front and back covers, said spine including top and bottom ends and two sides, wherein said front cover is foldably joined to one side of said spine and said back cover is foldably joined to the other side of said spine;

a flexible gusset having a front portion and a back portion, wherein said front portion of said gusset is rolled inwardly and attached to an outer periphery of said front cover running from said top of said spine to said bottom of said spine, and said back portion of said gusset is rolled inwardly and attached to an outer periphery of said back cover running from said top of said spine to said bottom of said spine, said gusset being attached such that when said binder is laid open said gusset is biased outwardly of said binder to facilitate access to the contents of said binder; and a closure means for releasably securing said front portion of said gusset to said back portion of said gusset when said front cover is folded substantially over said back cover.

14. The binder of claim 13 wherein said front and back covers inner sides include an inwardly directed attachment panel for attaching said front and back portions of said gusset, said gusset being inwardly rolled and attached to said panel thereby biasing said gusset outwardly of said binder.

15. The binder of claim 14 wherein said gusset is formed from a 150 denier woven polyester.

* * * * *